US005228955A

United States Patent [19]

Westbrook, III

[11] Patent Number: 5,228,955

[45] Date of Patent: Jul. 20, 1993

[54] HIGH STRENGTH COKE OVEN WALL HAVING GAS FLUES THEREIN

[75] Inventor: Richard W. Westbrook, III, Knoxville, Tenn.

[73] Assignee: Sun Coal Company, Knoxville, Tenn.

[21] Appl. No.: 886,804

[22] Filed: May 22, 1992

[51] Int. Cl.[5] ..... C10B 29/02

[52] U.S. Cl. ..... 202/93; 202/139; 202/223

[58] Field of Search ..... 202/93, 101, 102, 139, 202/222, 223, 267.1, 268; 432/247

[56] References Cited

U.S. PATENT DOCUMENTS

| | | | |
|---|---|---|---|
| 1,430,027 | 9/1922 | Plantinga . | |
| 1,486,401 | 3/1924 | Van Ackeren . | |
| 3,878,053 | 4/1975 | Hyde | 202/223 |
| 4,059,885 | 11/1977 | Oldengott | 29/491 F |
| 4,373,244 | 2/1983 | Mertens et al. | 29/402.08 |
| 4,445,977 | 5/1984 | Husher | 202/223 |
| 5,052,922 | 10/1991 | Stokman et al. | 432/181 |

FOREIGN PATENT DOCUMENTS

| | | | |
|---|---|---|---|
| 469124 | 12/1928 | Fed. Rep. of Germany | 202/223 |
| 662327 | 7/1938 | Fed. Rep. of Germany | 202/223 |

*Primary Examiner*—Joye L. Woodard
*Attorney, Agent, or Firm*—James L. Bean

[57] ABSTRACT

An improved coke oven wall constructed for refractory brick and having generally vertically extending gas flues formed therein employs different shaped brick to form the portion of the wall defining the flues in alternate courses of brick with the refractory brick in each course being shaped and arranged so that no mortar joint between two adjacent brick in any course is contained in a single vertical plane from a flue to the adjacent oven.

5 Claims, 3 Drawing Sheets

HIGH STRENGTH COKE OVEN WALL HAVING GAS FLUES THEREIN

BACKGROUND OF THE INVENTION

1. Field of the Invention

This invention relates to an improved hot gas flue or chimney structure in a nonrecovery coke oven wall constructed of refractory bricks with alternate courses of the portion of the wall surrounding the flue openings each being defined by bricks of two different shapes to provide improve strength and gastight integrity.

2. Description of the Prior Art

Modern nonrecovery coke ovens are constructed in batteries consisting of a plurality of individual ovens arranged in side-by-side relation with adjacent ovens having common sidewalls. The battery is heated by a system of sole flues extending beneath the floor of each oven. Gases evolved during the coking process are led from the oven crown, i.e., the space above the coal charge in the oven, to the sole flues through a system of flues or chimneys, called downcomers, in the sidewalls to the sole flues for combustion to heat the charge. Hot exhaust gases are drawn from the sole flues by draft applied from a stack through a second system of flues or chimneys, called uptakes, extending up through the sidewalls. Normally the uptakes for a plurality of ovens in the battery will be connected to a common stack through a connection main conduit or duct as illustrated, for example, U.S. Pat. No. 5,114,542. During operation of such ovens, sometimes referred to as Thompson ovens, the sidewalls including the downcomers and uptakes are subjected to substantial stress due both to the high loads applied during pushing and charging and to the high temperatures and thermal shocks encountered.

In a typical commercial Thompson coke oven battery, the temperature in the oven chamber and downcomers may be in the range of 2,000° to 2,400° F. during the coking operation, while the temperature in the uptakes may be as high as 2,600° F. during at least a portion of the cycle. At the end of the cycle the oven doors are opened and the charge of incandescent coke is pushed from the oven chamber, and a fresh charge of coal at ambient temperature is immediately deposited into the chamber. While the coal charge will ignite upon contact with the hot structure of the oven, substantial heat is immediately absorbed from the oven refractory by the coal charge, thereby subjecting the oven structure, including the sidewalls, to substantial stress due to the thermal shock. Pushing coke from an oven also places very high stresses on the sidewall as a result of pressure applied by the pushing machine to the end of the coke charge. Such stress can result in cracks in the sidewalls and these cracks frequently appear at the downcomers or uptakes where the walls are structurally weakened.

Since the entire oven system operates under a subatmosphere pressure as a result of the draft applied by the stack, any cracks in the oven sidewalls leading to the downcomers and uptakes will inherently result in gas leaking or flowing through the cracks to further erode and weaken the structure. Cracks leading to the uptakes or downcomers at a location below or near the surface of the charge can also cause excessive burning of the charge in that area thereby not only reducing the efficiency of the operation but also producing hot spots further eroding and weakening the structure at the crack.

A more serious problem may result from a crack leading into an uptake since unburned and partially burned distillation products bypass or shortcircuit the sole flues. Depending upon the extent of the leak, this can affect the temperature in the sole flues and thereby the coking rate in the oven. In any event, unburned distillation products shortcircuiting the system and leaking into the waste gas collection main may result in substantial atmospheric pollution even though the temperature in the collection main and stacks may be in the range of 1,800° F. The escape of unburned hydrocarbons and particulate material as a result of such a shortcircuit can result in having to shut down the battery to repair the oven wall. It is, therefore, a primary object of the present invention to provide a coke oven wall having gas flues therein and which is of improved strength and gastight integrity.

Another object of the invention is to provide a coke oven sidewall having downcomers and uptake flues therein defined by improved refractory brick which will provide increased strength and gastight integrity for the wall.

Another object is to provide such a structure in which the sidewall is constructed of refractory brick in which alternate courses of the brick in the portion of the wall defining the downcomer and uptake flues are of two different brick shapes to provide increased strength at the corners of the flues and at the brick joints.

SUMMARY OF THE INVENTION

In the attainment of the foregoing and other objects and advantages, an important feature of the invention resides in the use of specially shaped bricks in the construction of the portion of the oven sidewalls defining the vertically extending downcomer and uptake flues. The oven sidewalls are constructed of multiple courses of high strength, high temperature resistive refractory brick dimensioned and shaped to provide increased strength in the portion of the sidewalls bridging the downcomers and uptakes and at the high stress corner areas of the downcomers and uptakes, while avoiding any straightline mortar joint in a vertical plane leading from the oven chamber to the downcomers and uptakes. Two different shapes of brick are employed in each course of brick in the oven sidewall to define the respective flues, with the bricks in alternate courses in the sidewall being of different types to provide maximum strength for the walls while maintaining maximum gastight integrity for the flues. The two types of brick used for one course comprise a T-shaped brick (T brick) and a rectangular parallelepiped shaped (rectangular) brick. The two types of brick for the second course also comprise a rectangular brick and a second brick generally in the shape of a rectangular parallelepiped solid with a rectangular notch cut from one end corner portion, which second brick will generally be referred to herein as a notched brick.

For the courses employing the T brick the bricks are arranged so that a T brick defines and extends around each of the four corners of the individual generally rectangular flue with an interfitting T brick cooperating with the corner T bricks to define the portion of the sidewall bridging the flues and exposed in each of the adjacent ovens. Rectangular bricks cooperate with the corner bricks in the interior of the sidewalls to complete the remainder of the generally rectangular open core defining the downcomer or uptake flue opening.

In the courses employing the notched brick, two notched bricks have their respective notched ends interfitting and positioned in overlying relation to the T brick bridging the flue opening and extending along the length of the sidewall beyond the T brick. The overlapping or interfitting notched portions of the notched brick are positioned symmetrically about the vertical center plane of the associated flue transversely of the oven chambers. This arrangement repeated in alternate courses of brick throughout the height of the associated downcomer or uptake flue chamber provides a high strength wall structure having exceptional gastight integrity for reasons pointed out in greater detail hereinbelow. The size and configuration of the bricks used in the alternate courses of the portion of the sidewalls defining the flues cooperate to reinforce the sidewall while retaining the advantages of the built-up brick structure both from the standpoint of the initial construction and repair of the oven walls.

BRIEF DESCRIPTION OF THE DRAWINGS

Other features and advantages of the invention will be apparent from the detailed description contained hereinbelow, taken in conjunction with the drawings, in which.

DESCRIPTION OF A PREFERRED EMBODIMENT

Figure 1:
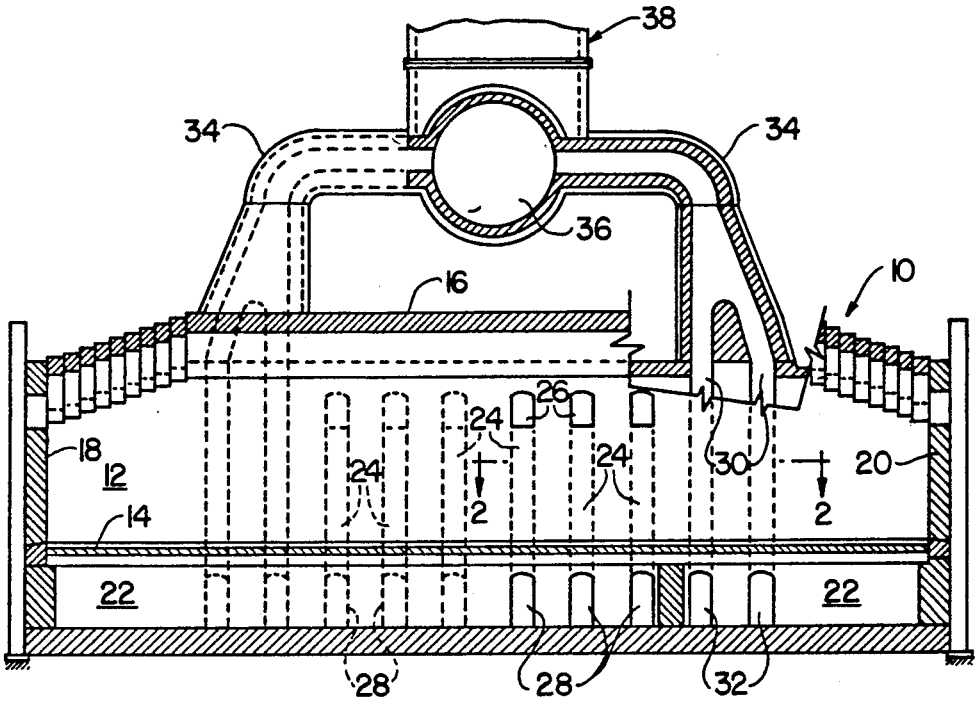
FIG. 1 is a vertical sectional view, with parts broken away and others omitted for clarity, schematically showing one of the sidewalls of a sole flue heated nonrecovery coke oven having downcomer and uptake flues constructed therein.

Nonrecovery sole flue heated coal coking ovens of the type schematically illustrated in FIG. 1 are known in the art and used commercially in the production of coke. One such oven is illustrated, for example, in U.S. Pat. No. 4,344,820 to Thompson, reference to which patent may be had for a more detailed description of the overall structure and operation of a nonrecovery coke oven battery.

In summary, individual ovens of the type indicated generally in FIG. 1 by the reference numeral 10 are constructed in a battery in side-by-side relation with adjacent ovens having common sidewalls 12, a floor 14 and an arch-shaped roof 16, all constructed from high temperature refractory brick. Opposite ends of the ovens 10 are closed during the coking operation by removable doors 18, 20. A system of sole flues 22 extend beneath the floor 14 of each oven, and a plurality of downcomer flues 24 having inlets 26 at a level above the charge of coal to be coked in the oven are constructed in the sidewalls 12. Downcomers 24 have outlets 28 discharging into the sole flues 22. A plurality of uptake chimneys 30 are also constructed in the sidewalls 12, with uptakes 30 having inlets 32 communicating with the sole flues to withdraw the hot exhaust gases and products of combustion from the sole flues. Uptakes 30 are connected, through chimney extensions 34 to a collection main 36 which in turn is connected to a stack 38. Preferably, a plurality of ovens are connected to a common stack and in one battery currently in operation, each stack is connected to nine individual ovens whereby a continuous flow of hot stack gases maintains a subatmospheric pressure throughout the system from the coking chamber to the stack.

Figure 2A:
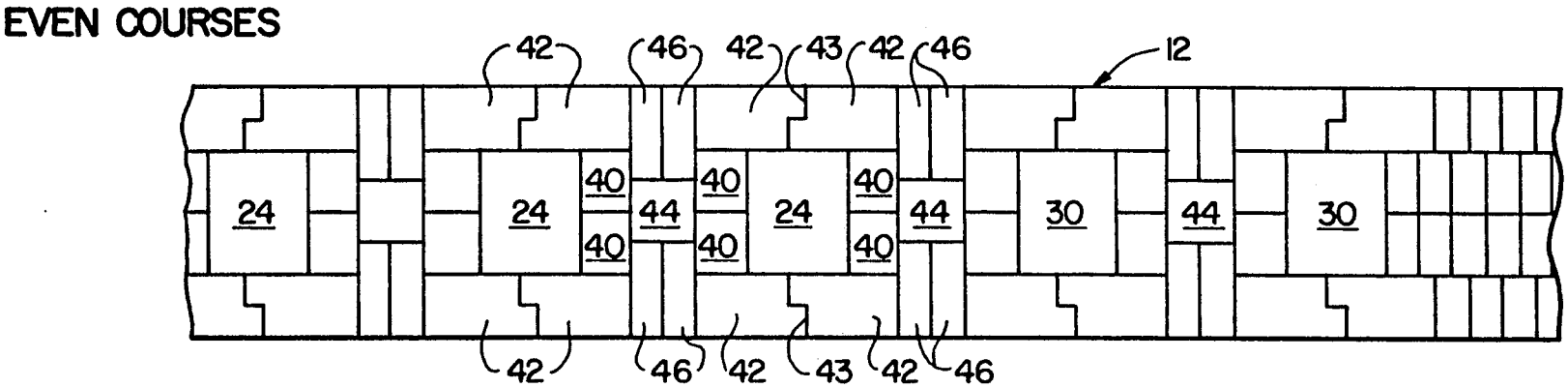
FIGS. 2A and 2B are enlarged, fragmentary sectional views taken along line 2—2 of FIG. 1 and showing the arrangement of bricks used in alternate courses of the brickwork employed to construct the oven sidewalls.
Figure 2B:
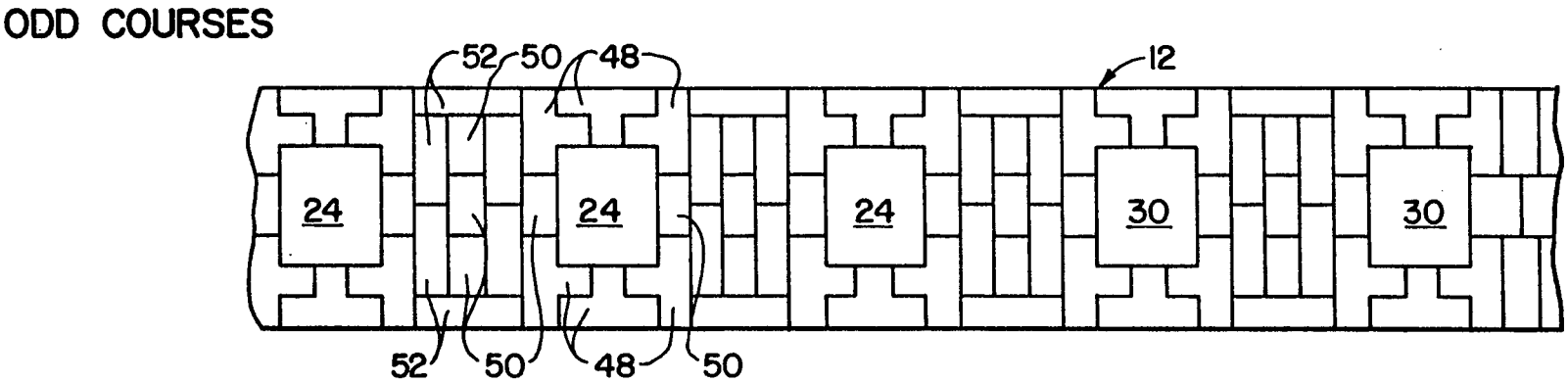
Figure 4:
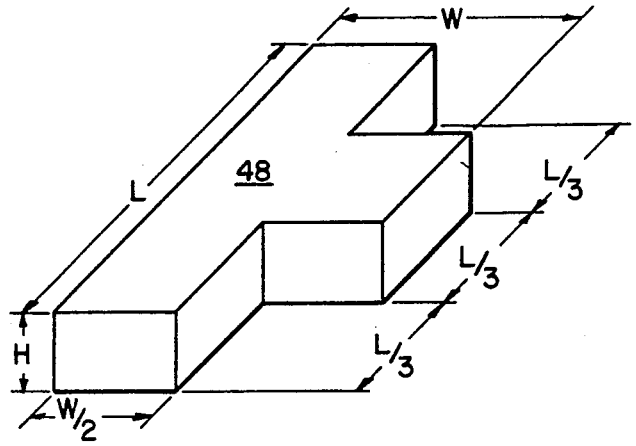
FIG. 4 is an isometric view of a T-shaped brick used in constructing the sidewall as shown in FIG. 2A.

In accordance with the present invention, the sidewalls 12 are constructed of refractory bricks, with alternate courses employing different shaped bricks in the portion of the wall extending around and defining the uptake and downcomer openings. These alternate courses are illustrated in FIGS. 2A and 2B, respectively, and for convenience will be referred to herein sometimes as even numbered courses and odd numbered courses. The arrangement and configuration of the bricks defining the downcomers and uptakes are such that the alternate courses cooperate to provide both high strength and gastight integrity.

The conventional rectangular shape of the downcomers and uptakes provide stress risers in the brickwork defining their corners. Further, the portion of the sidewalls bridging the downcomer and uptake flues is inherently the weakest portion of the sidewall so that it is important for the alternate odd and even courses of brick to cooperate to provide a high strength wall structure in this area. In accordance with the present invention, this is accomplished by use of bricks that extend around the corners in the odd courses and bricks having an increased length which extends past the corners in the even courses.

Figure 5:
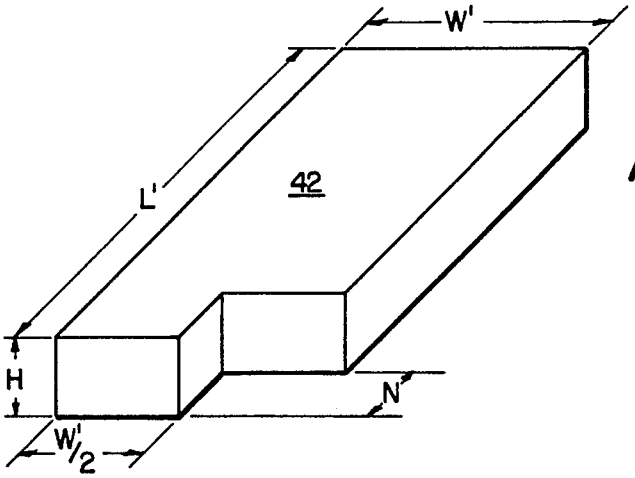
FIG. 5 is an isometric view of a notch-shaped brick used in constructing the sidewall as shown in FIG. 2B.

Referring to FIG. 2A, it is seen that the even numbered courses of brick in the sidewall 12 employ two generally rectangular brick 40 to define the downcomer and uptake sidewalls, i.e., the flue wall surface which extend perpendicular to the faces of the sidewall 12. The downcomer and uptake end walls which extend parallel to the face of wall 12 are each defined by a pair of notched brick 42. The notched bricks are illustrated in FIG. 5 where it is seen that a rectangular notch or corner portion is removed, or rabbeted, from one end only of the brick 42, with this notch extending approximately one half the width of the brick. The dimension of the notch longitudinally of the brick should be at least about one half of its dimension transversely of the brick.

As illustrated in FIG. 2A, the two brick 42 at each face of the downcomer or uptake, are arranged in shiplap relation so that the mortar joint 43 between them has an offset, i.e., the mortar joint does not extend in a plane between the vertical face of the sidewall and the vertical surface of the downcomer or uptake end wall, thereby improving the gastight integrity of the flue. Further, the length L' of the notched brick 42 is such that the two overlapping brick also extend outwardly in overlapping relation to the ends of the brick 40 to avoid any mortar joint at the stress riser corner portions of the flue. Thus, in the even courses, each flue 24 or 30 has its peripheral walls or surfaces defined by a brick core consisting of two pair of notched brick 42 arranged in shiplap relation and two pair of rectangular brick 40. The cores for adjacent flues in the oven 12 are then separated by the required number of appropriately dimensioned rectangular brick such as bricks 44 and 46.

Referring now to FIG. 2B, the odd numbered courses employ a brick 48 which is generally T-shaped in plan view to define each of the four corners, respectively, of the core defining each flue 24 or 30, with two additional T-shaped brick arranged to cooperate with the brick 48 defining the corners adjacent each sidewall face to bridge the flue 24 or 30 along that face of the sidewall 12. A pair of rectangular brick 50 cooperate with the corner T bricks 48 to complete the brick core defining the internal sidewalls of the downcomer or uptake flues. Thus, six T-shape brick and two rectangular brick define a core extending around each flue 24 and 30, with the cores of adjacent flues again being separated by a plurality of rectangular brick 50 and 52. Note that this arrangement again avoids any mortar joint extending in a vertical plane between the face of the sidewall 12 and the downcomer or uptake flues. Further, the "top" and "leg" portion of the T brick, which are integrally formed from a single mass of refractory material, cooperate to define each corner of the flue and form a portion of the flue sidewall and end wall at that corner, provides maximum structural integrity at the stress riser corner of the flue. Also, the "top" of the bridging T-shape brick extends the full width of the flue for structural strength.

Figure 3:
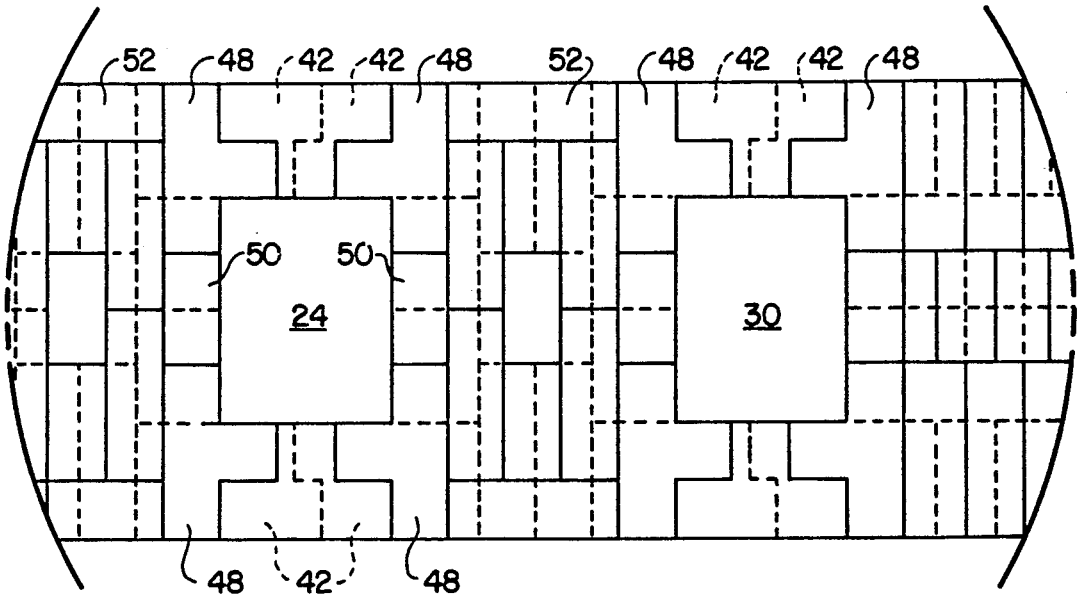
FIG. 3 is a further enlarged detail showing the overlapped relation of the alternate courses of brick shown in FIGS. 2A and 2B.

As shown in FIG. 3, the bricks 40 and 42 employed to define the core extending around the downcomer and uptake flues 24, 30, respectively, in the even courses, and the brick 48, 50 employed to define the core surrounding the flues 24, 30 in the odd courses are shaped and dimensioned such that there are no overlapping parallel mortar joints in the odd and even courses. Note, for example, that the shiplap-type mortar joint between the cooperating pairs of notched brick 42 falls within the main body portion of the bridging T brick 48 of the adjacent odd courses. This high strength, gastight structural arrangement is made possible with a relatively small number of special shaped brick as seen in FIGS. 4 through 7.

All brick used in both odd and even courses have a common thickness or height dimension H which preferably is about 3 inches. Still referring to FIG. 4, it is seen that the top portion 50 and leg portion 52 of T brick 48 are generally rectangular parallelograms in plan view, with leg portion 52 located centrally along one edge or face of the top 50. Also, the width of top portion and leg portion of the "T" are of equal dimension, or ½ the total width W of the brick. In a preferred embodiment, L may be about 14½" and W may be about 9".

As previously stated, the notched brick 42 are in the shape of a generally rectangular parallelopiped solid having one corner rabbeted across ½ its width to provide a shiplap-type joint when the notched ends of two such brick are positioned in abutting relation. In a preferred embodiment, the length L' may be about 14½" (14½" or even less) and the width W' about 9". The notched depth, along the length, may be about 2¼".

Figure 6:
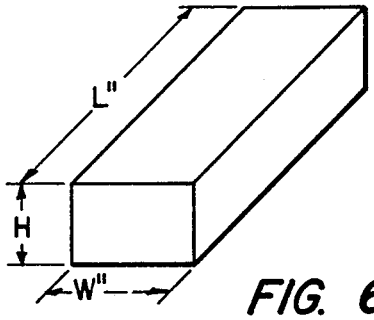
FIG. 6 is an isometric view of a rectangular shaped brick used in constructing the sidewall.

FIG. 6 represents various sizes of rectangular shaped bricks such as bricks 50 which have a thickness or height H equal to that of bricks 42 and 48, preferably about 3". The width W" preferably is about 4½" or half the width W and W' of bricks 42 and 48. The length L" may vary and in one configuration of the walls 12, such brick may have a dimension L" of 6¾", 9", 13½", or 18", depending upon the specific location where they are used in the wall structure.

Figure 7:
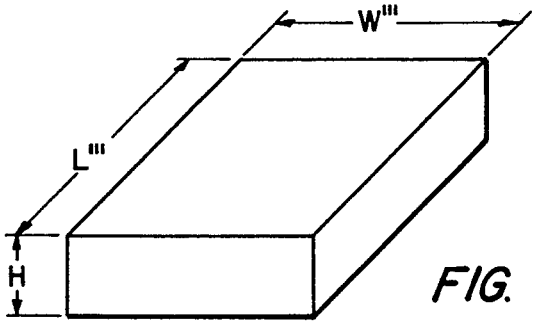
FIG. 7 is an isometric view of another rectangular shaped brick used in constructing the sidewall.

FIG. 7 illustrates a second rectangular brick shape such as the bricks 40 and 44. Both the width W''' and length L''' of this brick design may vary in accordance with the specific use in the wall structure. For example, this configuration when used at 44 may have a width of 9" and a length of 9" whereas when used at 40, the length may be 9" and the width 6¾". It should be understood, of course, that all such dimensions are given by way of example and merely illustrate the dimensions of brick employed in a specific oven design.

It has been found that the use of the T brick to define the corners of the flue opening in alternate courses of the sidewall brick work is of particular importance in providing increased structure integrity at the stress riser corners. Also, since the solid mass of refractory employed to form the T brick forms a portion of both the side and end wall surfaces of the flue opening, these bricks also greatly contribute to the improved gas tight integrity of the flues. The use of the rabbeted, or notched brick in overlying relation to the T brick in alternate courses cooperate to provide strength to the joints between the T brick and contribute to the strength of the wall structure bridging the flues.

What is claimed is:

1. In a nonrecovery coke oven battery including a plurality of coke ovens constructed in side-by-side relation with adjacent ovens in the battery being separated by a common sidewall having a face exposed in each said adjacent oven, and a plurality of generally rectangular flues formed in and extending generally vertically upward through each said common sidewall in spaced relation to one another, said flues having internal end surfaces generally parallel to said sidewall faces and side surfaces generally perpendicular to said sidewall faces, said sidewall being constructed of refractory brick separated by mortar joints and arranged in alternate odd and even courses with each course of brick including a plurality of groups of brick each cooperating to form a core having a rectangular opening extending therethrough defining a portion of one of said flues, the improvement wherein the refractory brick defining said cores in said even numbered courses comprise bricks of at least two shapes and the bricks defining the cores in the odd number of courses comprises bricks of at least two shapes, and wherein the shapes of the brick forming the core in said odd and in said even courses are different from one another, the refractory brick in each said core being shaped and arranged such that no mortar joint between two adjacent bricks defining any core is contained in a single vertical plane from a flue to the adjacent oven.

2. The invention defined in claim 1 wherein the brick defining each core in each said odd or each said even courses comprises a generally T-shaped brick located at each corner of the rectangular opening through that core with the T-shaped brick at each corner defining a portion of the end and side surfaces of the flue opening adjacent that corner.

3. The invention defined in claim 1 wherein the refractory brick in said sidewall between each said flue opening and the adjacent ovens in each said odd or each said even courses of brick consists of three T-shaped brick including a first T-shaped brick located at and defining one corner of said rectangular opening at said flue surface nearest said adjacent oven, a second T-shaped brick located at and defining the other corner of said rectangular opening at said flue surface nearest said adjacent oven, said first and second T-shaped bricks forming a portion of the end and side surfaces of the flue at the respective corners, and a third T-shaped brick positioned between and cooperating with said first and said second T-shaped brick to form a continuous refractory brick structure bridging the flue opening.

4. The invention defined in claim 1 wherein the brick defining each core in each said odd or each said even courses comprises a plurality of notched bricks in the general shape of a rectangular parallelopiped having a generally rectangular rabbet formed therein at one end, and wherein two such bricks having a rabbet formed therein are arranged to form a shiplap-type joint at a location between said flue side surfaces, said two notched brick forming the only brick structure in the portion of said sidewall in that course of brick bridging one end of each said flue.

5. The invention defined in claim 3 wherein the brick defining each core in each of the remaining courses of brick comprises a plurality of notched bricks in the general shape of a rectangular parallelopiped having a generally rectangular rabbet formed therein at one end, and wherein two such bricks having a rabbet formed therein are arranged to form a shiplap-type joint at a location between said flue side surfaces, said two notched brick forming the only brick structure in the portion of said sidewall in said each remaining course of brick bridging one end of each said flue.

* * * * *